United States Patent [19]

Simjian

[11] Patent Number: 4,638,996

[45] Date of Patent: Jan. 27, 1987

[54] EXERCISE APPARATUS

[75] Inventor: Luther G. Simjian, Fort Lauderdale, Fla.

[73] Assignee: Command Automation, Inc., Fort Lauderdale, Fla.

[21] Appl. No.: 767,524

[22] Filed: Aug. 20, 1985

[51] Int. Cl.[4] ..... A63B 23/02

[52] U.S. Cl. ..... 272/146; 272/126

[58] Field of Search ..... 272/146, 97, 96, 70, 272/73, 93, 120, 126, 128, 31 A, 30, 44, 31 R; 128/25 R, 25 B

[56] References Cited

U.S. PATENT DOCUMENTS 2,195,805 4/1940 Baker ..... 272/44

2,906,532 9/1959 Echols ..... 272/146

4,391,441 7/1983 Simjian ..... 272/146

4,432,543 2/1984 Normandin ..... 272/126

*Primary Examiner*—V. Millin

*Assistant Examiner*—S. R. Crow

[57] ABSTRACT

An exercise apparatus comprises a stationary support which supports a turntable platform for oscillating rotating motion. An arm exercising means in the form of a vertically disposed post is mounted forward of the perimeter of the platform. Responsive to oscillating rotating motion of the platform induced by a hip movement of the person standing on the platform, the post undergoes vertical reciprocating motion. Also, means are shown which, in addition to the motions described, cause the post to be driven in counter-rotation with the platform.

24 Claims, 11 Drawing Figures

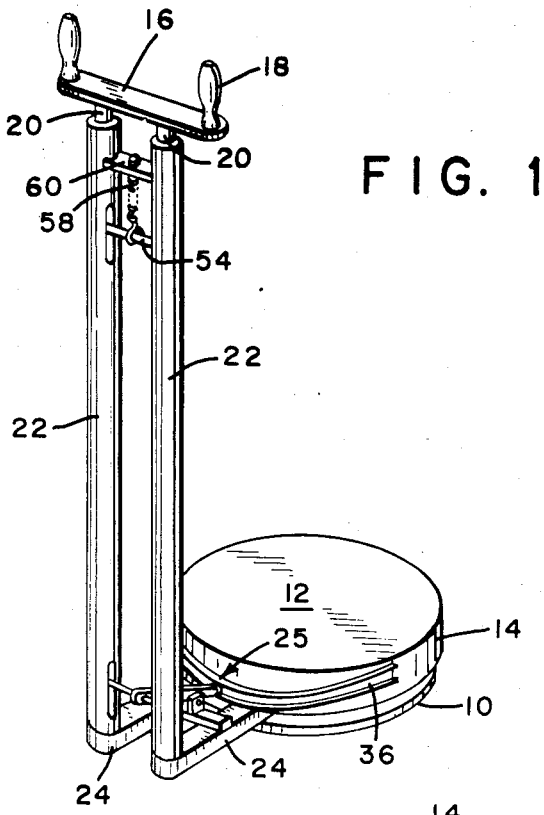
FIG. 1
FIG. 4A
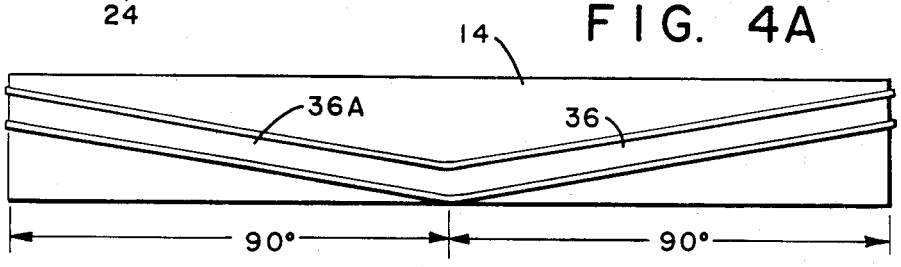
FIG. 4B
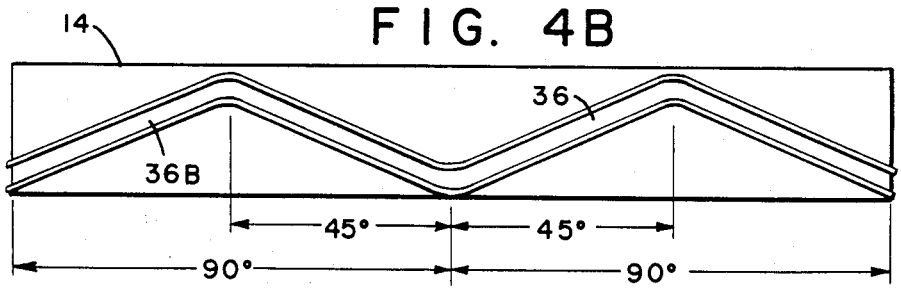

FIG. 6
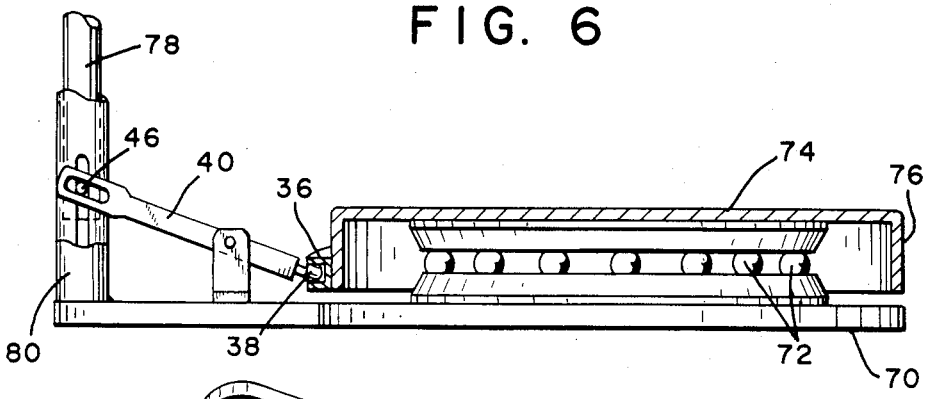
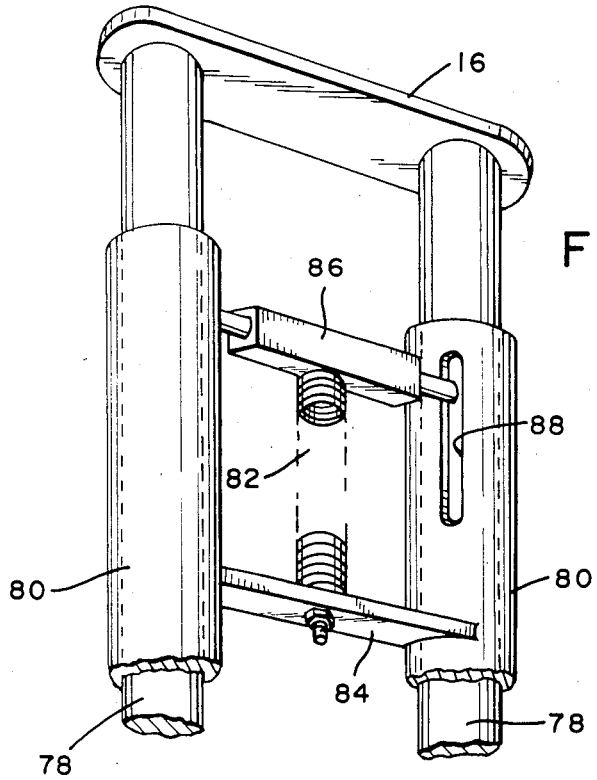
FIG. 7

EXERCISE APPARATUS

BRIEF SUMMARY OF THE INVENTION

This invention relates to exercise apparatus and, more specifically, refers to an exercise apparatus for exercising and toning main body muscles and arm muscles in a coordinated manner. Quite specifically, the present invention discloses an exercise apparatus wherein a person mounts a turntable platform and, responsive to a twisting motion initiated by a hip movement, the platform rotates and concomitantly, a post mounted forward of the perimeter of the platform and grasped by the person standing on the platform, undergoes coordinated reciprocating motion in a substantially vertical direction. Thus, motion is applied to the shoulders of the person. In one of the embodiments shown, not only does the post undergo reciprocating vertical motion, but is moved also in a counterrotating motion with respect to the rotating motion of the platform, thus providing a compound shoulder motion.

The present invention, moreover, is related to my previously issued U.S. Pat. Nos. 3,784,193 dated Jan. 8, 1974 entitled "Friction Type Exercising Device with Separate Handgrip Exercise"; 4,313,603 dated Feb. 2, 1982; 4,390,180 dated June 28, 1983; 4,391,441 dated July 5, 1983, all entitled "Exercise Apparatus" wherein coordinated motion between a rotatable platform and a post disposed in front of the perimeter of the platform has been disclosed. The present invention, in contrast with the prior patents, which show rotating motion of the post and reciprocating motion of the post toward and away from the platform, reveals constructions in which the post or posts undergo reciprocating motion in the substantially vertical direction responsive to oscillating rotating motion of the platform.

It is an object of this invention, therefore, to provide a novel and useful exercise apparatus.

It is another important object of this invention to provide an exercise apparatus which provides coordinated exercise for the body muscles, arm and shoulder muscles of a person using this apparatus.

It is a further object of this invention to provide an exercise apparatus comprising a platform mounted for reciprocating rotational motion and means for producing coordinated oscillating motion to the arm and shoulder muscles of a person standing on the platform and holding on to the post disposed in front of the perimeter of the platform.

Still further and other important objects of this invention will be more clearly apparent from the following description when taken in conjunction with the accompanying drawings.

BRIEF DESCRIPTION OF THE DRAWINGS

FIG. 1 is a perspective view of a first embodiment of the exercise apparatus according to the present invention;

FIGS. 4A and 4B are schematic views of typical cam means useable with the embodiment per FIG. 1;

FIG. 6 is a vertical view, partly in section, showing an alternative embodiment of the invention;

FIG. 7 is a perspective view illustrating an alternative spring bias construction;

DETAILED DESCRIPTION OF THE INVENTION

Figure 2:
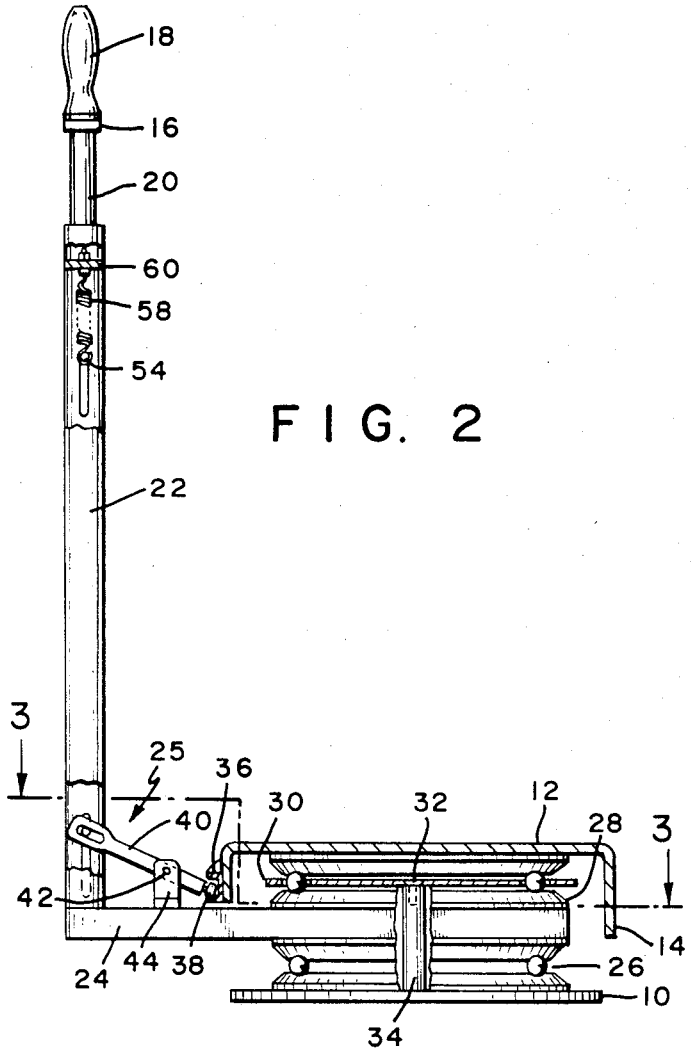
FIG. 2 is a vertical view, partly in section, of the embodiment per FIG. 1.

Referring now to the figures and FIGS. 1 to 5 in particular, there is shown a first embodiment of the present apparatus comprising, as best seen in FIG. 1, a stationary support 10 upon which is mounted a turntable platform 12 which has a skirt 14 depending along the side of the platform. The turntable platform 12 is adapted to support a person in standing position which will grasp with one or two hands a handle bar 16 provided with suitable handgrips 18. The handle bar 16 is attached to the upper end of a pair of vertically disposed posts 20 which are mounted for reciprocating motion in a vertical direction in respective tubes 22. The lower ends of the tubes are mounted to mounting means in the form of a set of rails 24 which extend from an area between the support 10 and the platform 12 and terminate in front of the perimeter of the circular platform 12 at which point the tubes 22 and posts 20 extend upwardly. The platform 12 is mounted upon the support in a manner as to permit oscillating rotating motion of the platform by a person standing thereupon, such motion being effected by a suitable hip movement of the person. Responsive to the rotating movement the platform 12 the posts 20 and tubes 22 undergo concomitant counterrotation. Simultaneously, a drive means, generally identified by numeral 25, coupled between the platform 12 and the posts 20 causes the posts 20 to undergo motion also along the vertical direction within the tubes 22. Therefore, as the platform 12 rotates in one direction, the rails 24 with tubes 22 are caused to rotate in the other direction while simultaneously, the posts 20 reciprocate in the vertical direction. By causing the platform to undergo a reciprocating rotating motion, the other motions also follow a reciprocating path.

Figure 3:
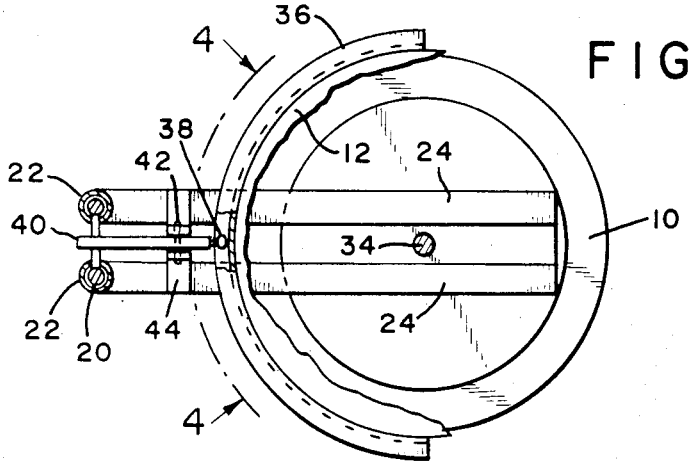
FIG. 3 is a plan view along section lines 3—3 in FIG. 2.

As best seen in FIGS. 2 and 3, the rails 24 are mounted between a set of antifriction bearing assemblies 26 and 28. The rails 24 either are rigidly clamped between the bearing assemblies or are welded to the respective juxtaposed housing plates of the bearing assemblies 26 and 28. The upper bearing assembly 28 includes a ball spacing plate 30 which is retained stationary by being secured by means of a screw 32 to a stationary vertical support post 34 secured to the support 10. Hence, as the platform 12 rotates about the post 34 in one direction, the balls of the bearing assembly 28, being held stationary by the spacing plate 30, cause the rails 24 to be driven in the opposite direction. The lower bearing assembly 26 accommodates rotation of the rails 24 relative to the stationary support 10.

The skirt 14 is fitted along its frontal side with suitable cam means 36, typically, a "U"-shaped channel. The cam means in a typical example is curved, such as a "V"-shaped configuration, note FIG. 4A, numeral 36A, or in another example is an inverted "W", see numeral 36B, FIG. 4B. This cam means, which may be of other suitably curved configuration, is designed to provide vertical reciprocating motion to the posts 20 responsive to rotation of the platform. The drive means 25 includes a cam follower 38 engaging the cam means and coupled to a pivoted lever 40, a pivot pin 42, a pillow block 44, a cross pin 46 fitting through a slot 48 of the pivoted lever 40 and fastened to the posts 20, see FIG. 5. In order to accomodate vertical motion of the cross pin 46 to cause vertical motion of the posts 20, the tubes 22 are provided with respective slots 50. Near the upper end of the tubes, a further cross pin 54 fits through the respective vertical slots 56 provided in the tubes and is fastened to the posts 20. A helical tension spring 58, see FIGS. 1 and 2, is fastened with one end to the cross pin 54 and with the other end to a brace 60 in order to bias the posts 20 toward their raised position.

Hence, depending upon the cam means configuration, as the platform rotates through 180 degrees, the posts 20 are displaced from the lowered position to the raised position and returned to the lowered position, see FIG. 4A, or displaced from the raised position, then lowered, raised, lowered and returned to the raised position, see FIG. 4B. Simultaneously, the posts 20 rotate in the direction opposite to that of the platform 12. These motions provide a compound motion to the arms and shoulders of a person standing on the platform and grasping the handle 18 with both hands.

FIG. 6 shows an alternative embodiment of the present invention. In contrast with the previous embodiment, the posts 20 undergo only vertical motion, but do not undergo a rotational motion counter to that of the platform. A support 70 supports a single antifriction bearing assembly 72 upon which is mounted a platform 74 having a skirt 76. Hence, the platform 74 is adapted to rotate relative to the support 70. The support 70 also supports in front of the perimeter of the circular shaped platform 74, a pair of tubes 80, fixed to the support 70, each tube confining therein for sliding vertical motion a respective post 78. The skirt 76 has attached thereto cam means 36 of suitable configuration as explained in connection with FIGS. 4A and 4B. A cam follower 38, pivoted lever 40, cross pin 46, etc., cause the posts 78 to be moved in a vertical direction responsive to an oscillating rotating motion imparted to the platform 74. A helical compression spring 82 mounted with one end to the fixed brace 84 and with the other end to a cross brace 86 secured to the posts 78 and adapted to slide in vertical slots 88 disposed in the tubes 80 causes the posts 78 to be biased toward their raised position.

Figure 8:
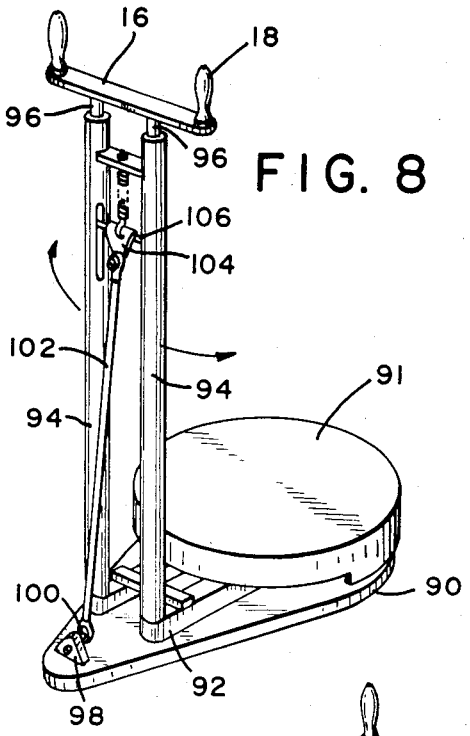
FIG. 8 is a perspective view of a further alternative embodiment of the invention.
Figure 9:
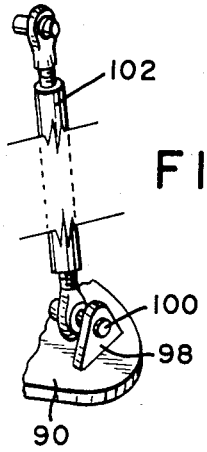
FIG. 9 is a perspective view illustrating in greater detail certain features shown in FIG. 8.

FIGS. 8 and 9 disclose another alternative embodiment of the present invention. A stationary support 90 supports a platform 91 by bearing means (not shown) but substantially identical with those shown in FIGS. 2 and 3. Mounting means in the form of a set of rails 92 are mounted for counterrotation relative to the rotation of the platform 91, as shown in FIGS. 2 and 3. An upstanding tube 94 is supported by each respective rail 92 and each tube 94, in turn, supports therein for vertical motion a respective post 96. A person standing on the platform 91 and grasping the handgrips 18 and causing the platform 91 to undergo oscillating rotating motion will experience concomitant counterrotating oscillating motion of the posts 96. In addition, reciprocating vertical motion of the posts 96 is provided by the combination of a bracket 98 secured to the support 90, a universal coupling joint 100, a turnbuckle linkage arm 102, connecting means 104 and a cross pin 106 coupled to the posts 96.

Figure 5:
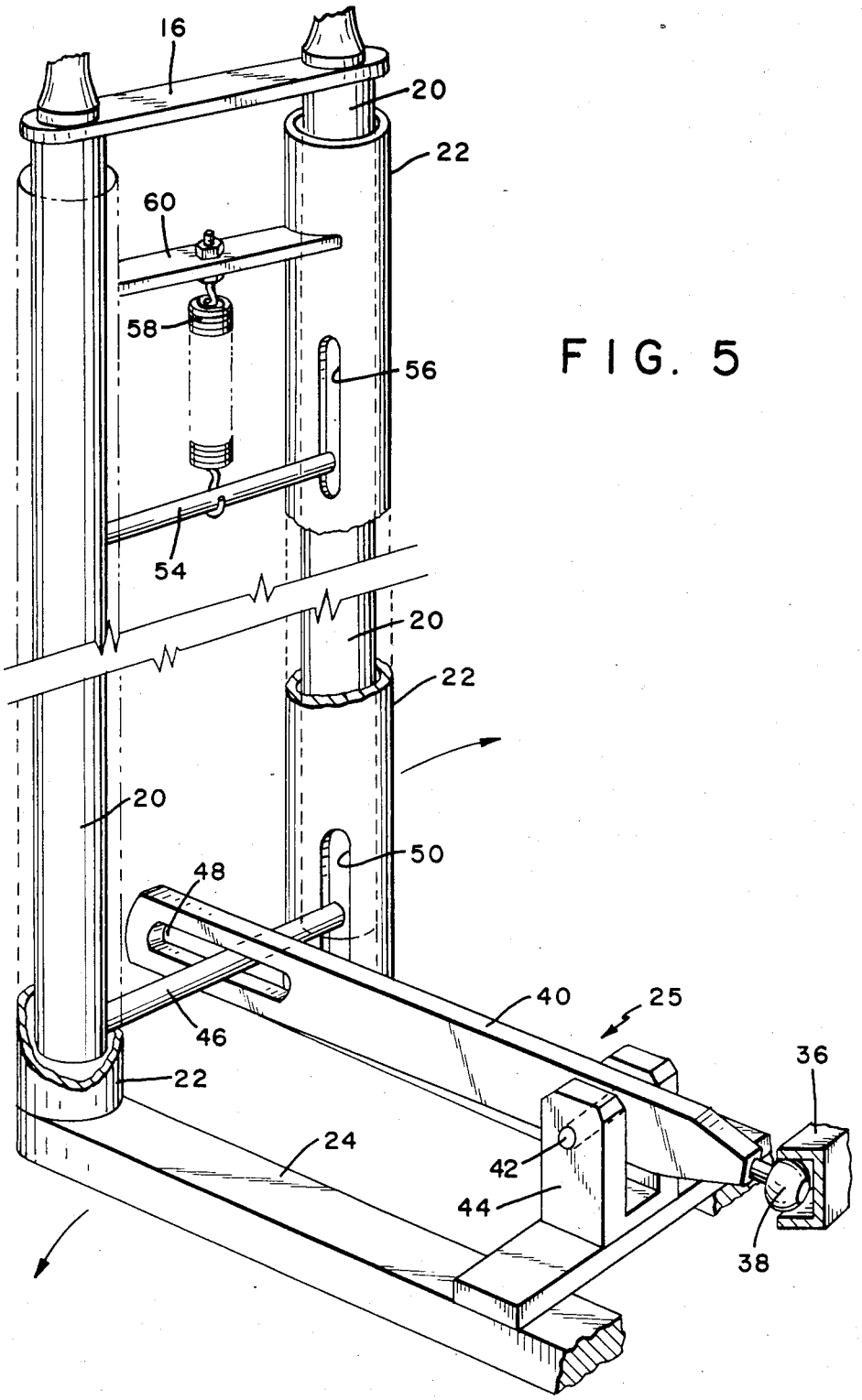
FIG. 5 is a perspective view illustrating some of the linkage means in greater detail.

Spring bias means are provided as explained in connection with the description of FIG. 5 for urging the posts toward their raised position. Hence, responsive to the rotating motion of the platform 91 and the counterrotation of the rails 92, the posts 96 and handle bar 16 undergo vertical motion. Therefore, the embodiment per FIGS. 8 and 9 has substantially the same exercise effect as the embodiment per FIGS. 1 through 5.

Figure 10:
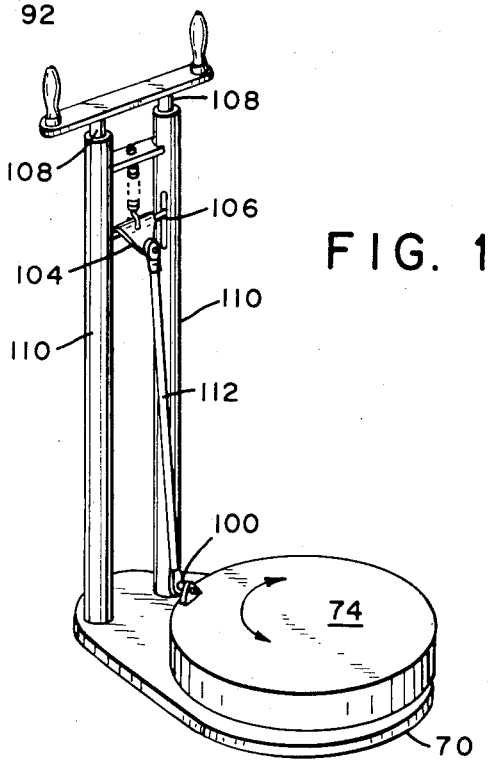
FIG. 10 is a perspective view of a still further and alternative embodiment of the present invention.

FIG. 10 is an embodiment similar to the embodiment per FIG. 6. The stationary support base 70 supports for rotating motion a platform 74 by means of a bearing means, as shown in FIG. 6. A set of posts 108 is supported for vertical motion in tubes 110 which at their lower ends are affixed to the stationary base 70. A universal coupling joint 100 is fastened to the platform 74 and a linkage rod 112 is coupled with one end to the joint 100 and with the other end to connecting means 104 and cross pin 106 which is secured with its ends to the posts 108. Spring bias means as mentioned heretofore are provided. As described in connection with FIG. 6, oscillating rotating motion of the platform 74 causes concomitant reciprocating vertical motion of the posts 108.

It will be appreciated by those skilled in the art that the motion of the posts can be amplified by suitable dimensioning of the linkage means. In addition, while no motion limiting means have been shown for the platform, it is advisable to provide end stops for the rotating motion of the platform.

In another embodiment, not illustrated, the universal coupling joint and linkage arm may be replaced by a cable or cord which is guided by suitable means around corners. The cord is in its "home" position when the platform is at its central position, at which time the posts are in their raised position. As the platform rotates, the cord pulls the posts downward. A spring biases the posts toward their raised position.

In another and further embodiment, the tubes and posts can be mounted to be tilted with respect to the vertical axis to accommodate different stances desired by a person using the described apparatus.

Furthermore, motor means may be coupled to the platform to assist a less skilled person in obtaining reciprocating motion of the platform.

While there have been described and illustrated several preferred embodiments of my invention, it will be apparent to those skilled in the art that various additional changes and modifications may be made without departing from the broad principle of this invention which shall be limited only by the scope of the appended claims.

What is claimed is:

1. An exercise apparatus comprising:

a stationary support;

a turntable platform mounted upon said support for oscillating rotating motion about a centrally disposed axis of said platform and adapted to support a person in standing position;

at least one substantially vertically disposed post mounted forward of the perimeter of said platform and supported for reciprocating substantially vertical, linear motion, and drive means coupled between said platform and said post for causing, responsive to oscillating rotating motion of said platform, said post to be driven in reciprocating vertical motion.

2. An exercise apparatus as set forth in claim 1, said drive means including cam means disposed on said platform; a cam follower engaging said cam means, and a pivotally mounted link member coupled with one end to said cam follower and with the other end coupled to said post.

3. An exercise apparatus as set forth in claim 1, and including means for biasing said post toward one end position of its vertical motion.

4. An exercise apparatus as set forth in claim 2, said turntable platform including a skirt, and said cam means being disposed on said skirt.

5. An exercise apparatus as set forth in claim 4, said cam means being of curved configuration.

6. An exercise apparatus as set forth in claim 5, said curved configuration being a "V".

7. An exercise apparatus as set forth in claim 5, said curved configuration being a "W".

8. An exercise apparatus as set forth in claim 1, said drive means including a universal joint and a linkage means.

9. An exercise apparatus as set forth in claim 8, said universal joint being mounted to said platform and said linkage means coupling said joint to said post.

10. An exercise apparatus as set forth in claim 8, said universal joint being mounted to said stationary support and said linkage means coupling said joint to said post.

11. An exercise apparatus as set forth in claim 1, there being a pair of posts.

12. An exercise apparatus as set forth in claim 11, and means for coupling said posts to one another for concomitant motion.

13. An exercise apparatus comprising:

a stationary support;

a turntable platform mounted upon said support for oscillating rotating motion about a centrally disposed axis of said platform and adapted to support a person in standing position;

mounting means extending from said platform and supporting at a position forward of the perimeter of said platform at least one substantially vertical post mounted for reciprocating motion along a substantially vertical, linear direction;

means coupled between said platform and said mounting means for causing, responsive to rotating motion of said platform, said mounting means with post supported thereupon to be driven in counter-rotation, and drive means coupled for causing said post to be driven along the substantially vertical, linear direction responsive to the rotating motion of said platform.

14. An exercise apparatus as set forth in claim 13, said means coupled between said platform and said mounting means comprising bearing means.

15. An exercise apparatus as set forth in claim 13, said drive means including cam means disposed on said platform; a cam follower engaging said cam means, and a pivotally mounted link member coupled with one end to said cam follower and with the other end coupled to said post.

16. An exercise apparatus as set forth in claim 13, and including means for biasing said post toward one end position of its vertical motion.

17. An exercise apparatus as set forth in claim 15, said turntable platform including a skirt, and said cam means being disposed on said skirt.

18. An exercise apparatus as set forth in claim 15, said cam means being of curved configuration.

19. An exercise apparatus as set forth in claim 18, said curved configuration being a "V".

20. An exercise apparatus as set forth in claim 18, said curved configuration being a "W".

21. An exercise apparatus as set forth in claim 13, said drive means including a universal joint and a linkage means.

22. An exercise apparatus as set forth in claim 21, said universal joint being disposed on said support and said linkage means coupling said joint to said post.

23. An exercise apparatus as set forth in claim 13, said mounting means supporting a pair of posts.

24. An exercise apparatus as set forth in claim 23, and means coupling said posts to one another for concomitant motion along the substantially, linear vertical direction.

* * * * *